US006258501B1

(12) United States Patent
Wada

(10) Patent No.: US 6,258,501 B1
(45) Date of Patent: Jul. 10, 2001

(54) DEVELOPING AGENT AND IMAGE FORMING APPARATUS

(75) Inventor: Hidekatsu Wada, Yachiyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/501,211

(22) Filed: Feb. 10, 2000

(51) Int. Cl.[7] ..... G03G 9/083
(52) U.S. Cl. ..... 430/106.6; 430/122; 399/267
(58) Field of Search ..... 430/106.6, 108, 430/111; 399/122, 267

(56) References Cited

U.S. PATENT DOCUMENTS 5,853,937 * 12/1998 Asawae et al. ..... 430/106.6
5,976,747 * 11/1999 Sato et al. ..... 430/108
6,087,057 * 7/2000 Hakata et al. ..... 430/108

FOREIGN PATENT DOCUMENTS 9-6106 1/1997 (JP) .
2888490 2/1999 (JP) .

* cited by examiner

*Primary Examiner*—John Goodrow
(74) *Attorney, Agent, or Firm*—Foley & Lardner

(57) ABSTRACT

Disclosed is a two-component developing agent comprising toner which includes a second magnetic powder added in an amount of 4 wt % or less with respect to the weight of toner particles which contains a first magnetic powder and a binder resin, and manganese-magnesium-based carrier.

22 Claims, 3 Drawing Sheets

DEVELOPING AGENT AND IMAGE FORMING APPARATUS

BACKGROUND OF THE INVENTION

The present invention relates to an image forming apparatus such as an electrophotographic apparatus or an electrostatic recording apparatus and a developing agent used in the apparatus and, more particularly, to an image forming apparatus for performing development by the magnet rotating development method and a two-component developing agent containing magnetic toner and carrier for use in the apparatus.

An image forming apparatus using the magnet rotating development method is disclosed in, e.g., Jpn. Pat. Appln. KOKOKU Publication No. 7-40156. In this apparatus, a developing roller facing an image carrier for carrying an electrostatic latent image is composed of a hollow cylindrical rotary sleeve made of a nonmagnetic material and a magnetic roll formed inside this sleeve, said magnetic roll having a plurality of magnetic poles and being able to rotate independently of the sleeve.

In the magnet rotating development method, a two-component developing agent containing magnetic carrier and magnetic toner formed by adding a magnetic material to the surfaces of toner particles is applied to the developing roll. The magnetic roll and the sleeve are rotated in the same direction or in opposite directions to convey the developing agent to a development region while the developing agent itself is rotated. In this magnet rotating development method, control of the specific toner density is easier than in the common magnet fixed development method, so the specific toner density can be increased. This increases the toner conveyance amount and raises the development efficiency. When the magnetic roll and the sleeve are rotated in the same direction, the rotating direction of the developing agent is opposite to its conveyance direction. When the magnetic roll and the sleeve are rotated in opposite directions, the rotating direction of the developing sleeve is the same as its conveyance direction. This is suitable for high-speed development because the conveyance amount can be further increased.

In two-component development by the magnet fixed development method, the specific toner density on a developing roll is commonly about 6 wt %. However, in two-component development by the magnet rotating development method, the specific toner density stays around about 50 wt %. The result is the advantage that so-called beads carry over which is a phenomenon in which the carrier on a developing roll adheres to an image carrier hardly occurs. In the magnetic fixed development method, to prevent this carrier transfer and control the charge amount, the surface of a magnetic carrier is coated with a silicon-based coating material.

Unfortunately, in magnetic toner used in the magnet rotating development method, a magnetic powder is mixed in and adhered to the toner in an amount of 4.5 wt % with respect to the toner weight. Although high-quality images can be provided initially, the externally added magnetic powder causes some inconveniences.

Representative inconveniences are the following three phenomena.

The first is an increase in wear of the surface of a photoreceptor due to the externally added magnetic powder. When the surface of a photoreceptor wears, its sensitivity lowers, so no stable electrostatic charge can be provided any longer. This reduces the life of the photoreceptor.

The second is an increase in wear of a cleaning blade due to the externally added magnetic powder. When a cleaning blade wears, inferior cleaning takes place, leading to deterioration of images.

The third is an increase in wear of the surface film of a heat roller due to the externally added magnetic powder. When the surface film of a heat roller wears, high-temperature offset occurs. This reduces the life of the heat roller.

These inconveniences significantly reduce the prescribed life of an apparatus when the externally added magnetic powder is used.

In contrast, toner containing no magnetic powder effectively eliminates the above inconveniences. However, at high temperatures and high humidities conventional magnetic carrier such as a Cu—Zn carrier causes inferior electrostatic charge. Accordingly, image density lowers when a developing agent containing such carrier is used. Also, when highly chargeable magnetic carrier is used, the chargeability of the toner becomes too high. Consequently, image density lowers when sheets are continuously fed. Furthermore, highly chargeable magnetic carrier has small electrical resistance and magnetic force margins and hence is difficult to rationalize.

BRIEF SUMMARY OF THE INVENTION

The present invention has been made in consideration of the above situation, and has as its first object to provide an image forming apparatus capable of preventing deterioration of the image quality and life by minimizing damage to a photoreceptor surface, a cleaning blade, and a heat roller surface film, and also capable of maintaining a good charging characteristic and forming images having high image density even at high temperatures and high humidities or even after being left to stand for twenty-four hours.

It is the second object of the present invention to provide a developing agent capable of preventing deterioration of the image quality and life by minimizing damage to a photoreceptor surface, a cleaning blade, and a heat roller surface film due to a second magnetic powder present on a toner surface, and also capable of maintaining a good charging characteristic and forming high-quality images having high image density, with no flocculation of particles of the developing agent, even at high temperatures and high humidities or even after being left to stand for twenty-four hours.

According to one aspect of the present invention, there is provided a developing agent comprising toner which contains toner particles containing a first magnetic powder and a binder resin and contains a second magnetic powder added in an amount of 4 wt % or less with respect to the weight of the toner particles, and manganese-magnesium-based carrier.

According to the second aspect of the present invention, there is provided an image forming apparatus comprising at least one image carrier, a developing unit, a transfer unit, and a cleaning device arranged in order on the image carrier to oppose the image carrier, the developing unit containing a developing agent comprising toner which contains toner particles containing a first magnetic powder and a binder resin and contains a second magnetic powder added in an amount of 4 wt % or less with respect to the weight of the toner particles, and manganese-magnesium-based carrier, and comprising a developing roller which comprises a hollow cylindrical rotary sleeve for carrying the developing agent and a magnet roll having a plurality of magnetic poles and capable of rotating independently of the sleeve, and a fixing unit having a pair of fixing rollers placed downstream of the transfer unit.

When the present invention is used, the magnetic powder amount used can be reduced while a satisfactory charging characteristic is maintained. Therefore, it is possible to prevent deterioration of the image quality and life by minimizing damage to a photo-receptor surface, a cleaning blade, and a heat roller film surface. It is also possible to maintain a good charging characteristic and obtain high-quality images having high image density, with no flocculation of particles of a developing agent, even at high temperatures and high humidities or even after the developing agent is left to stand for twenty-four hours.

DETAILED DESCRIPTION OF THE INVENTION

A developing agent of the present invention comprises toner which contains toner particles containing a first magnetic powder and a binder resin and includes a second magnetic powder, and manganese-magnesium-based carrier, characterized in that the addition amount of the second magnetic powder is 4 wt % or less with respect to the weight of the toner particles.

Also, an image forming apparatus of the present invention uses the above developing agent and comprises at least one image carrier, a developing unit, a transfer unit, and a cleaning device arranged in order on the image carrier to oppose the image carrier, and a fixing unit having a pair of fixing rollers placed downstream of the transfer unit, characterized in that the developing unit contains a developing agent comprising toner which contains toner particles containing a first magnetic powder and a binder resin and includes a second magnetic powder added in an amount of 4 wt % or less with respect to the weight of the toner particles, and manganese-magnesium-based carrier, and comprises a developing roller which comprises a hollow cylindrical rotary sleeve for carrying the developing agent and a magnet roll having a plurality of magnetic poles and capable of rotating independently of the sleeve.

When the present invention is used, the charging characteristic of a developing agent applied to an image forming apparatus using the magnet rotating development method can be improved by using manganese-magnesium-based carrier. Consequently, the amount of a second magnetic powder used in the toner can be reduced. Also, the charging characteristic is stable even at high temperatures and high humidities or even after the developing agent is left to stand for twenty-four hours. This prevents flocculation of developing agent particles. Furthermore, various inconveniences caused by a second magnetic powder can be suppressed by reducing the amount of the second magnetic powder. For example, it is possible to suppress wear of the photoreceptor surface and prevent deterioration of the photoreceptor sensitivity, unstable electrostatic charge, and reduction of the photoreceptor life. It is also possible to suppress wear of a cleaning blade used in a cleaning device and prevent inferior cleaning and image deterioration. Additionally, it is possible to suppress wear of the fixing roller surface film and prevent high-temperature offset and reduction of the heat roller life.

As described above, according to the present invention high-quality images can be obtained with a good charging characteristic and no lowering of the image density.

The present invention will be described in detail below with reference to the accompanying drawings.

Figure 1:
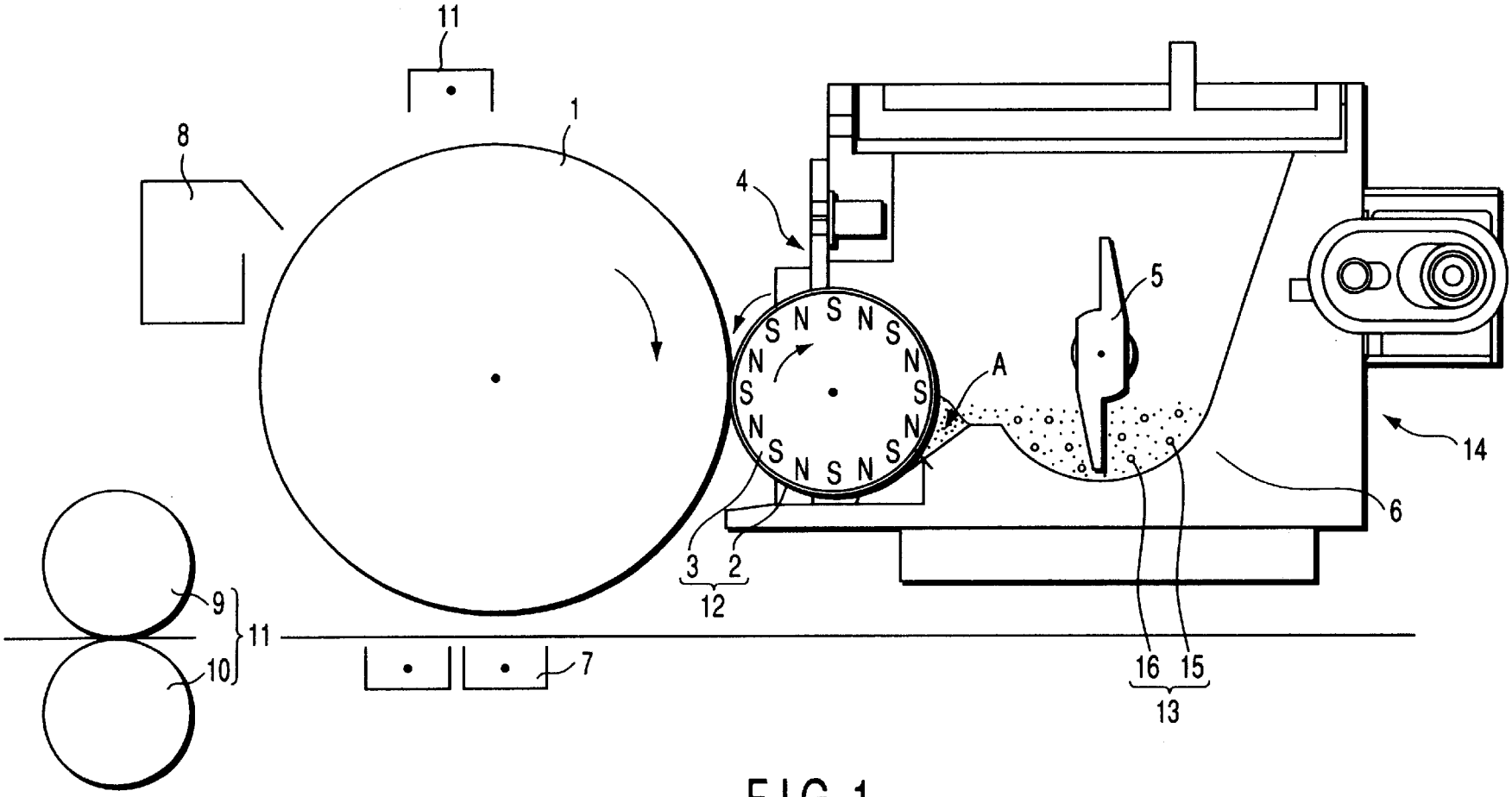
FIG. 1 is a schematic view showing the arrangement of an image forming apparatus according to the present invention.

FIG. 1 is a schematic view showing the arrangement of an image forming apparatus according to the present invention.

As shown in FIG. 1, this image forming apparatus basically comprises a photoreceptor drum 1 as an image carrier; a developing unit 14, a transfer unit 7, a cleaning device 8, and a charger 11 arranged in this order on the photoreceptor drum 1; and a fixing device 11 having a pair of fixing rollers 9 and 10 placed in the subsequent stage of the transfer unit 7.

The photoreceptor drum 1 carries an electrostatic latent image on its surface and rotates in the direction of an arrow. The developing unit 14 facing this photoreceptor drum 1 includes the following components. A developing agent container 6 of this developing unit 14 is formed integrally with a housing to which a toner cartridge can be attached. This developing agent container 6 contains a developing agent 13 according to the present invention which contains toner 16 and carrier 15. A developing roller 12 is positioned at the lower edge of the developing agent container 6 where the developing roller 12 opposes the photoreceptor drum 1. This developing roller 12 includes a hollow cylindrical developing sleeve 2 made of a nonmagnetic material and a magnet roller 3 accommodated in the developing sleeve 2 and having a plurality of magnetic poles extending in the axial direction. The developing sleeve 2 and the magnet roller 3 are coaxially formed to be rotatable relative to each other. In this developing unit, the developing sleeve 2 rotates clockwise and the magnet roller 3 rotates counterclockwise. Accordingly, the rotating direction of the developing agent is the same as its conveyance direction, so the conveyance amount can be increased. This makes high-speed development feasible. A developing agent regulating blade 4 is a nonmagnetic body. A stirrer 5 stirs the developing agent 13 to prevent flocculation and also conveys the developing agent 13 to the developing roller 12.

The gap between the photoreceptor drum 1 and the developing sleeve 2 is 0.35 mm. The gap between the developing agent regulating blade 4 and the developing sleeve 2 is 0.30 mm.

The magnetic toner is stirred and followed by the stirrer 5 and thereby supplied to a developing agent magnetic attraction region A. The magnetic toner magnetically attracted in this developing agent attraction region A is attracted to the surface of the developing sleeve 2. The magnetic carrier 15 is stirred together with the toner 16 while being rotated by the rotation of the magnet roller 3, thereby performing electrostatic charging.

The ratio of the toner weight to the carrier weight on the developing sleeve 2, i.e., the specific toner density, stays around about 50%. The toner amount with respect to the magnetic carrier is large compared to the conventional magnet fixed two-component development method. Also, in the conventional magnet fixed development method, the toner density must change within the range of specific toner density ±1 wt %, since inconveniences such as beads carry over and density reduction easily occur. In the magnet rotating development method, however, no image inconveniences occur even for a fluctuation of specific toner density ±20 wt %. The developing agent conveyed on the sleeve 2 passes by the developing agent regulating blade 4 to have a prescribed developing layer thickness and is developed into an electrostatic latent image on the photoreceptor drum 1.

The first magnetic powder can be used as a magnetic body and a colorant.

The first and second magnetic powder is preferably magnetite typically such as $Fe_3O_4$.

The first and second magnetic powder preferably has a particle size of 0.2 to 10 $\mu$m.

The first and second magnetic powder can consist of the same or different component, can be the same and different in composition or particle size.

The magnetic carrier used preferably has a particle size of 10 to 100 $\mu$m.

Examples of the binder resin used are stylene-acryl resins.

Examples of black colorants are various carbon blacks manufactured by, e.g., a thermal black method, an acetylene black method, a channel black method, a furnace black method, and a lamp black method.

It is also possible to use 0.5 to 5 parts by weight of low-molecular-weight polypropylene, low-molecular-weight polyethylene, liquid paraffin, acid amide, or wax such as stearic acid wax, montan-based wax, sazol wax, custar wax, chlorinated wax, or carnauba wax, provided that the color reproducibility is not adversely affected.

Examples of an additive which can be mixed in toner particles are fine silica particles, fine metal oxide particles, and a cleaning aid. Examples of the fine silica particles are particles of silicon dioxide, aluminum silicate, sodium silicate, zinc silicate, and magnesium silicate. Examples of the fine metal oxide particles are particles of zinc oxide, zinc titanate, aluminum oxide, zirconium oxide, strontium titanate, barium titanate, and zinc stearate. Examples of the cleaning aid are fine resin powders of polymethylmethacrylate, polyvinylidene fluoride, and polytetrafluoroethylene. These additives can be mixed in an amount of 0.2 to 2 parts by weight with respect to the toner particle weight where necessary. It is also possible to use additives subjected to a surface treatment, e.g., a treatment of giving hydrophobic nature.

As a method of manufacturing the toner particles, it is possible to use a wet dispersion method which uses a high-speed dissolver, a roll mill, or a ball mill as a mixing/dispersing means, or a melt kneading method which uses a roll, a pressure kneader, an internal mixer, or a screw extruder.

As a preliminary mixing means, it is possible to use, e.g., a ball mill, a V mixer, a forberg, or a Henschel mixer.

As a means for coarsely grinding a mixture of toner particle materials, it is possible to use, e.g., a hammer mill, a cutter mill, a roller mill, or a ball mill.

As a means for finely grinding the coarsely ground product, a jet mill, a high-speed rotary pulverizer, or the like can be used.

As a means for classifying the finely ground product, an air classifier or the like can be used.

A second magnetic powder and other additives can be added to the obtained toner particles by mixing them in a high-speed rotary mixer represented by a Henschel mixer. These additives can be supplied together, or different types of additives can be supplied separately. That is, additives can be mixed under most effective conditions.

Developing agents 1, 2, 3, 4, and 5 having the following compositions were prepared by changing the addition amount of the second magnetic powder to toner to 0, 2, 4, 4.5, and 6 wt %, respectively.

Developing Agent Composition

Toner

First magnetic powder: magnetite
40 to 60 parts by weight

Binder resin: styrene-acryl-based resin
40 to 60 parts by weight

Wax: polypropylene wax
0 to 6 parts by weight

Second magnetic powder: magnetite
0 to 6 parts by weight

Carrier: Mn-Mg-based carrier 60 $\mu$m in diameter
specific toner density 100%

Other additives:

| | |
|---|---|
| stearate | 0.01 to 0.5% |
| silica | 0.7% |

Each developing agent was formed as follows.

First, the binder resin, the first magnetic powder, and wax described above were melted and kneaded. The resultant kneaded product was dried, pulverized, and classified to obtain toner particles having an average particle size of about 9 to 11 $\mu$m.

The second magnetic powder and silica were mixed in the toner particles by a Henschel mixer to obtain toner.

The magnetic carrier was mixed in the toner by a stirring mixer to obtain a developing agent.

Image formation was performed using each resultant developing agent, and the photoreceptor wear amount and the number of inferiorly cleaned copies were measured.

The photoreceptor wear amount was measured by conducting a paper feed test and measuring the initial wear amount and the wear amount after 60,000 paper sheets were fed.

The number of inferiorly cleaned copies was measured by checking data every 10,000 copies.

When the toner containing 4.5 wt % or more of the magnetic powder with respect to the toner particles was used, as described in the problems of the prior art, inconveniences such as photosensitive film wear and cleaning blade wear occurred. Consequently, the life reduced and noise images were formed.

Figure 2:
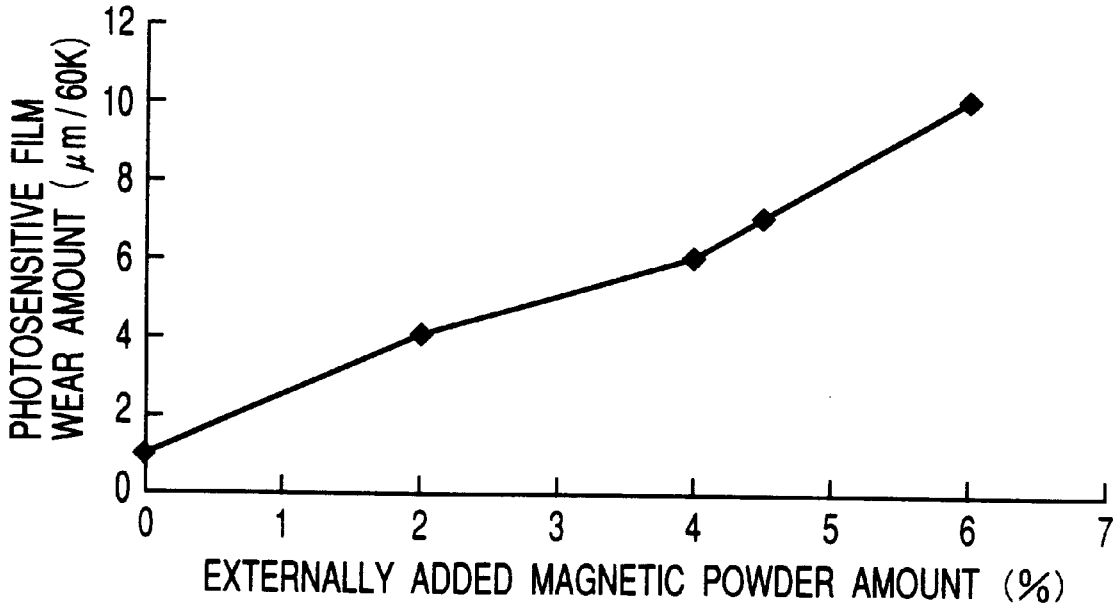
FIG. 2 is a graph showing the relationship between the second magnetic powder amount in toner and photoreceptor wear.

FIG. 2 is a graph showing the relationship between the second magnetic powder amount in toner and the photoreceptor wear amount.

Figure 3:
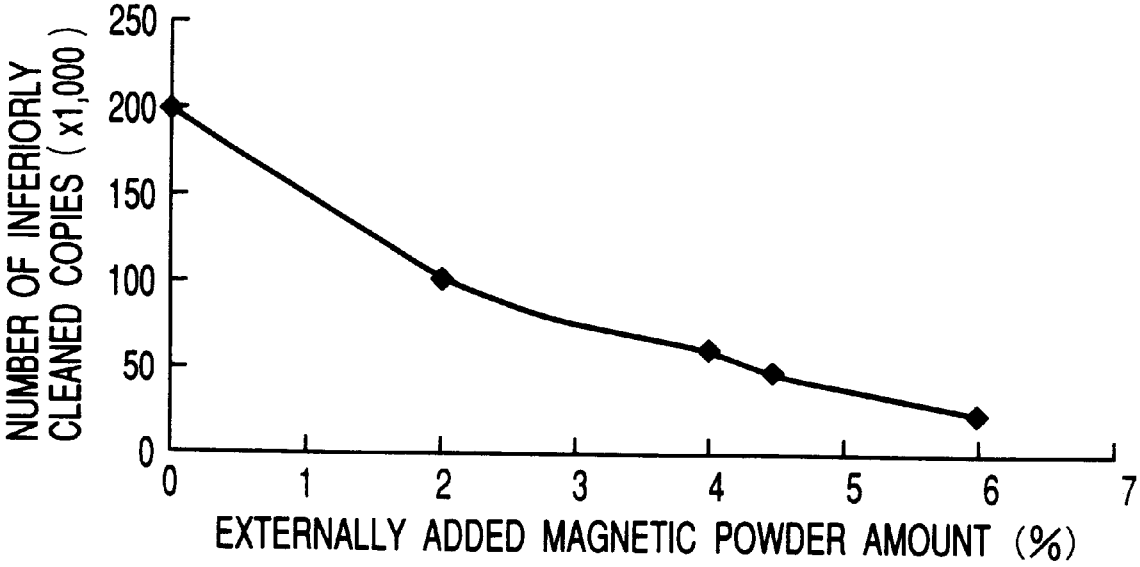
FIG. 3 is a graph showing the relationship between the second magnetic powder amount in toner and the number of inferiorly cleaned copies.

FIG. 3 is a graph showing the relationship between the second magnetic powder amount in toner and the number of inferiorly cleaned copies.

As shown in FIGS. 2 and 3, when the developing agent containing 4.5 wt % or more of the second magnetic powder with respect to the toner particles was used, as described in the problems of the prior art, inconveniences such as photosensitive film wear and cleaning blade wear occurred. Consequently, the life reduced and noise images were formed. It is therefore found that these inconveniences of the prior art can be well improved by setting the second magnetic powder amount to less than 4 wt %.

Developing agents were also formed to have the above composition except that magnetic carriers different in chargeability were used and the second magnetic powder amount was 2 wt %. Reductions in the image density at high temperatures and high humidities and at the start of copying after standing for twenty-four hours were checked.

Figure 4:
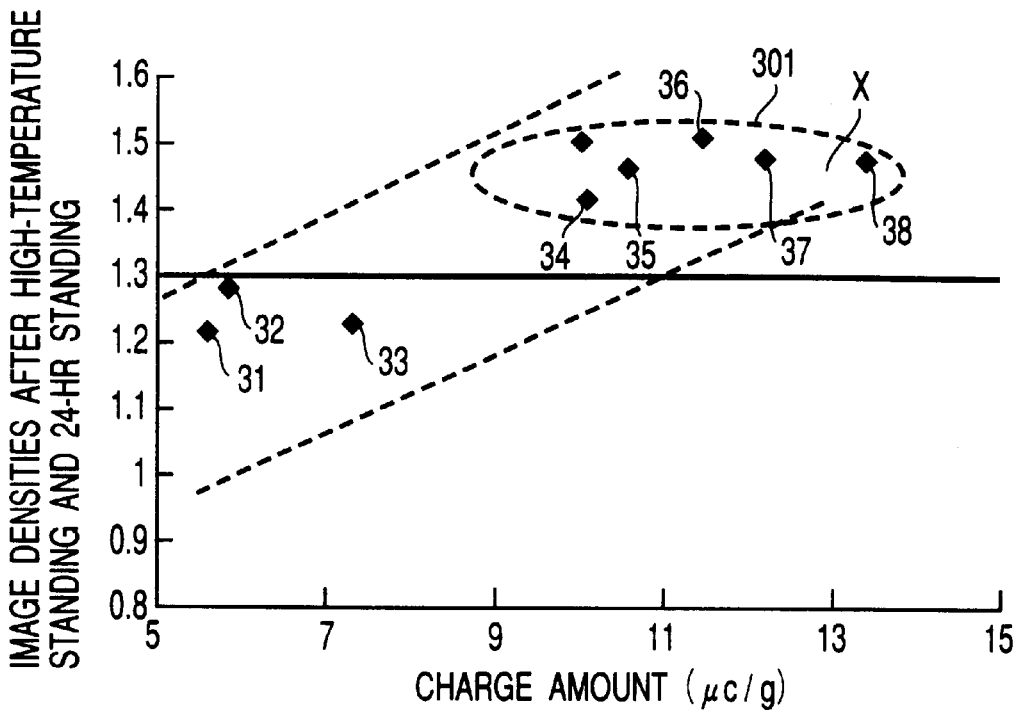
FIG. 4 is a graph plotting the relationship between the charge amount of magnetic carrier and the image density after standing at high temperature and for twenty-four hours.

FIG. 4 is a graph plotting the relationship between the charge amount of each magnetic carrier and the image densities after high-temperature standing at 30° C. and 85RH for ten hours and after standing for twenty-four hours.

Referring to FIG. 4, a dot 31 indicates a Cu—Zn-based noncoat carrier; 32, an MF noncoat carrier; 33, a Cu—Zn silicon-coated carrier; 34, a thin Cu—Zn acryl-coated carrier; 35, a thick (highly chargeable) Cu—Zn acryl-coated carrier; 36, an Mn—Mg noncoat carrier; 37, an Mn—Mg acryl-coated carrier; and 38, an MF acryl-coated carrier.

Note that the image density was measured with a Macbeth meter.

Carriers in a region X surrounded by a broken line 301 are made from highly chargeable materials. The other carriers are made from lowly chargeable materials.

Mn—Mg as a highly chargeable material was found to be effective to lower the density, as indicated by the dot 35, compared to the conventional magnetic carrier Cu—Zn or MF magnetite material indicated by the dot 31 or 32, respectively.

This Mn—Mg-based magnetic carrier has the advantage that its electrical resistance value and magnetic characteristic can be largely changed by the composition, the manufacturing conditions, or the like. In the conventional magnet fixed development method, however, the chargeability of the core of the carrier itself is high, so the obtained image density is unsatisfactory. Hence, the method has been put into practical use by forming a coating layer, e.g., a silicon-based coating layer for charging control on the carrier surface. In the magnet rotating development method, on the other hand, the specific toner density is higher than in the magnet fixed development method. Therefore, no carrier transfer occurs even when no such coating layer is formed on the magnetic carrier.

In the present invention as described above, the use of this Mn—Mg-based material can improve the image density reduction of toner using no second magnetic powder at high temperatures and high humidities or after the toner is left to stand for twenty-four hours.

Figure 5:
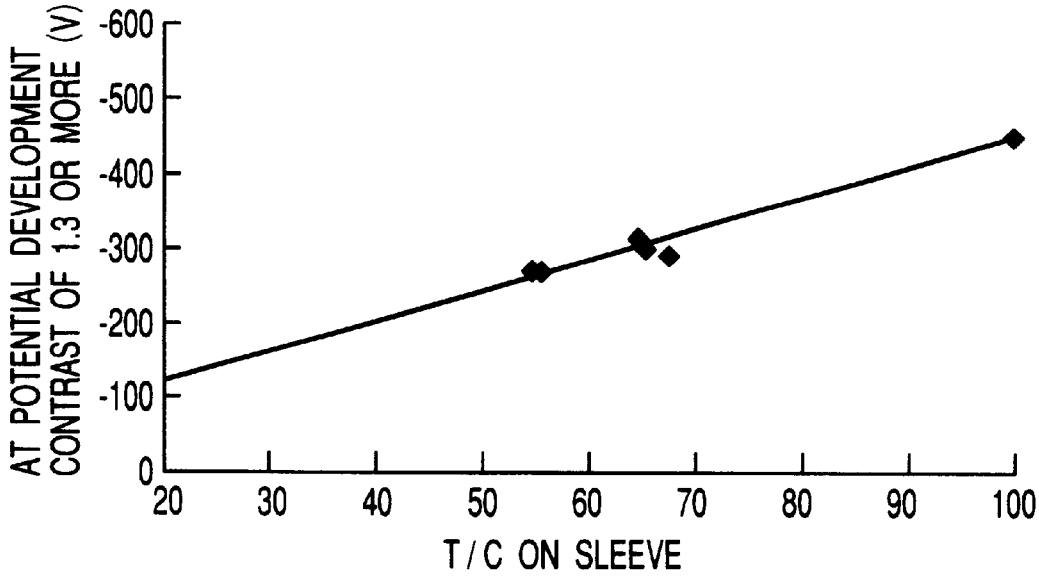
FIG. 5 shows graphs indicating the relationship between the specific toner density and the image density.

Developing agents were further formed to have the aforementioned composition except that the specific toner density was changed and the second magnetic powder amount was 2 parts by weight. The image density and density curve of each developing agent were measured. FIG. 5 shows graphs indicating the relationship between the specific toner density and the developing bias electric potential when the image density is 1.3.

FIG. 5 reveals that when the specific toner density of the developing roller rises and the carrier amount reduces, the image density lowers. When the carrier amount reduces, charging of the toner itself becomes unstable, leading to density reduction. When the specific toner density reduces to 20 wt % or less, the carrier adheres to images.

FIG. 5 shows that the specific toner density is preferably 20 to 70 wt % in the present invention.

What is claimed is:

1. A developing agent including toner which comprises toner particles containing a first magnetic powder and a binder resin and further comprises a second magnetic powder mixed with the toner particles in an amount of not more than 4 wt % with respect to the weight of said toner particles, and a manganese-magnesium-based carrier.

2. An agent according to claim 1, wherein said manganese-inagnesium-based carrier has no surface coating layer.

3. An agent according to claim 1, wherein the ratio of the weight of said toner to the weight of said carrier is 20 to 70 wt %.

4. An agent according to claim 1, wherein said first and second magnetic powders are substantially made from magnetite.

5. An agent according to claim 1, wherein said carrier has a particle size of 10 to 100 $\mu$m.

6. An agent according to claim 1, wherein said binder resin contains a styrene-acryl resin.

7. An agent forming apparatus comprising;

at least one image carrier;

a developing unit, a transfer unit, and a cleaning device arranged in order on said image carrier to oppose said image carrier, said developing unit containing a developing agent including toner which comprises toner particles containing a first magnetic powder and a binder resin and further comprises a second magnetic powder mixed with the toner particles in an amount of not more than 4 wt % with respect to the weight of said toner particles, and a manganese-magnesium-based carrier, and comprising a developing roller which comprises a hollow cylindrical rotary sleeve for carrying said developing agent and a magnet roll having a plurality of magnetic poles and capable of rotating independently of said sleeve; and a fixing unit having a pair of fixing rollers placed downstream of said transfer unit.

8. An apparatus according to claim 7, wherein said manganese-magnesium-based carrier has no surface coating layer.

9. An apparatus according to claim 7, wherein the ratio of the weight of said toner to the weight of said carrier is 20 to 70 wt %.

10. An apparatus according to claim 7, wherein said first and second magnetic powders are substantially made from magnetite.

11. An apparatus according to claim 7, wherein said carrier has a particle size of 10 to 100 $\mu$m.

12. An apparatus according to claim 7, wherein said binder resin contains a styrene-acryl resin.

13. An apparatus according to claim 7, wherein a rotating direction of said magnet roll is opposite to a rotating direction of said sleeve.

14. A development method characterized by comprising the steps of carrying a developing agent including toner which comprises toner particles containing a first magnetic powder and a binder resign and further comprises a second magnetic powder mixed with the toner particles in an amount of not more than 4 wt % which respect to the weight of said toner particles, and a manganese-magnesium-based carrier, on a developing roller opposing an image carrier and comprising a hollow cylindrical sleeve which rotates in synchronism with said image carrier, and a magnet roll which has a plurality of magnetic poles and rotates in an opposite direction to said sleeve, and forming a developing agent image by developing an electrostatic latent image formed on said image carrier.

15. A method according to claim 14, wherein said manganese-magnesium-based carrier has no surface coating layer.

16. A method according to claim 14, wherein the ratio of the weight of said toner to the weight of said carrier is 20 to 70 wt %.

17. A method according to claim 14, wherein said first and second magnetic powders are substantially made from magnetite.

18. A method according to claim 14, wherein said carrier has a particle size of 10 to 100 $\mu$m.

19. A method according to claim 14, wherein said binder resin contains a styrene-acryl resin.

20. A developing agent according to claim 1, wherein said toner particles are obtained by the steps of:

melting and kneading the binder resin and the first magnetic powder to produce a resultant kneaded product; and drying, pulverizing, and classifying the resultant kneaded product.

21. An apparatus according to claim 7, wherein said toner particles are obtained by the steps of:

melting and kneading the binder resin and the first magnetic powder to produce a resultant kneaded product; and drying, pulverizing, and classifying the resultant kneaded product.

22. A method according to claim 14, wherein said toner particles are obtained by the steps of:

melting and kneading the binder resin and the first magnetic powder to produce a resultant kneaded product;

drying, pulverizing, and classifying the resultant kneaded product.

* * * * *